US011803136B2

(12) United States Patent
Kojima

(10) Patent No.: US 11,803,136 B2
(45) Date of Patent: Oct. 31, 2023

(54) ELECTROPHOTOGRAPHIC BELT AND ELECTROPHOTOGRAPHIC IMAGE FORMING APPARATUS

(71) Applicant: CANON KABUSHIKI KAISHA, Tokyo (JP)

(72) Inventor: Hiroomi Kojima, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/047,321

(22) Filed: Oct. 18, 2022

(65) Prior Publication Data

US 2023/0143902 A1 May 11, 2023

(30) Foreign Application Priority Data

Nov. 5, 2021 (JP) ..... 2021-181535
Nov. 5, 2021 (JP) ..... 2021181535
(Continued)

(51) Int. Cl.
*G03G 15/01* (2006.01)
*G03G 15/16* (2006.01)

(52) U.S. Cl.
CPC ..... *G03G 15/162* (2013.01); *G03G 15/1605* (2013.01); *G03G 2215/1623* (2013.01)

(58) Field of Classification Search
CPC ..... G03G 15/1605; G03G 15/162; G03G 2215/1623
See application file for complete search history.

(56) References Cited

U.S. PATENT DOCUMENTS 9,034,476 B2 5/2015 Uchida et al.
10,866,543 B2 12/2020 Hamana et al.
(Continued)

FOREIGN PATENT DOCUMENTS

EP 1 112 837 A1 7/2001
EP 2 818 939 A1 12/2014
(Continued)

OTHER PUBLICATIONS

Kojima, U.S. Appl. No. 18/050,113, filed Oct. 27, 2022.
(Continued)

*Primary Examiner* — Joseph S Wong
(74) *Attorney, Agent, or Firm* — VENABLE LLP

(57) ABSTRACT

An electrophotographic belt includes a biaxially stretched cylindrical film as a base layer, wherein the biaxially stretched cylindrical film includes crystalline polyester, amorphous polyester and carbon black, a content of the carbon black with respect to the biaxially stretched cylindrical film is 2.0% by mass or more, and a surface resistivity measured on the surface of the biaxially stretched cylindrical film in an environment of 23° C. and 50% RH is $1\times10^3$ Ω/square or higher and $1\times10^{13}$ Ω/square or lower, and A/B is 3.00 or smaller, where A (Ω/square) represents a surface resistivity of the biaxially stretched cylindrical film after the film is left to stand for 24 hours in an environment of 23° C. and 50% RH, and B (Ω/square) represents a surface resistivity of the biaxially stretched cylindrical film after the film is left to stand for 24 hours in an environment of 30° C. and 80% RH.

20 Claims, 5 Drawing Sheets

(30) Foreign Application Priority Data

Jun. 16, 2022 (JP) ..... 2022-097284
Jun. 16, 2022 (JP) ..... 2022097284

(56) References Cited

U.S. PATENT DOCUMENTS

| | | | | |
|---|---|---|---|---|
| 2009/0180791 | A1* | 7/2009 | Matsushita | G03G 15/50 399/66 |
| 2011/0249995 | A1* | 10/2011 | Uchida | G03G 15/162 399/308 |
| 2015/0370199 | A1 | 12/2015 | Kojima | |
| 2018/0364621 | A1* | 12/2018 | Sasaki | B32B 27/18 |
| 2020/0363756 | A1 | 11/2020 | Hamana et al. | |
| 2022/0308504 | A1 | 9/2022 | Kojima | |

FOREIGN PATENT DOCUMENTS

| | | | |
|---|---|---|---|
| JP | 2003-005538 | A | 1/2003 |
| JP | 2006-233150 | A | 9/2006 |
| JP | 2007-292851 | A | 11/2007 |
| JP | 2009-265343 | A | 11/2009 |
| JP | 2012-011743 | A | 1/2012 |

OTHER PUBLICATIONS

Extended European Search Report in European Application No. 22205233.4 (dated Mar. 2023).
Extended European Search Report in European Application No. 22203513.1 (dated Mar. 2023).

* cited by examiner

ELECTROPHOTOGRAPHIC BELT AND ELECTROPHOTOGRAPHIC IMAGE FORMING APPARATUS

BACKGROUND

Technical Field

The present disclosure relates to an electrophotographic belt and an electrophotographic image forming apparatus including the electrophotographic belt.

Description of the Related Art

In an electrophotographic image forming apparatus, an electrophotographic belt formed from a thermoplastic resin and having an endless shape is used as a conveying transfer belt for conveying a transfer material or an intermediate transfer belt. Such an electrophotographic belt is required to have high strength, and electroconductivity of, for example, a surface resistance in the range of from $1\times10^3$ Ω/square to $1\times10^{13}$ Ω/square.

Japanese Patent Application Laid-Open No. 2006-233150 discloses a problem of a preform containing a large amount of carbon black, that is, reduced elongation upon stretching of the preform and difficulty in biaxially stretching the preform. Then, it is disclosed that such a problem can be solved by using a thermoplastic resin having a specific constitutional unit and a thermoplastic elastomer.

Japanese Patent Application Laid-Open No. 2006-233150 also discloses in its Examples 1 to 3 that the preform can be biaxially stretched by use of resins of polyethylene naphthalate, polyethylene terephthalate, and two types of thermoplastic elastomers (trade name: Pelestat 6321; Sanyo Chemical Industries, Ltd., and trade name: Tuftec M1913; Asahi Kasei Corp.), even if containing a large amount of carbon black as to exceed 10 parts by mass with respect to 100 parts by mass of the resin component, and a biaxially stretched cylindrical film has been obtained which can be used for an intermediate transfer belt.

The thermoplastic elastomer "Pelestat 6321" used herein is polyether ester amide and functions as an ion conductive agent. Because of this, the electroconductivity of the biaxially stretched cylindrical film obtained here has varied depending on the surrounding environment, in some cases. The present inventors have recognized that in order to more stably form a high-quality electrophotographic image even under various environments, the change of the surface resistance of the electrophotographic belt is a problem to be solved, which originates in the surrounding environment.

SUMMARY

At least one aspect of the present disclosure is directed to providing an electrophotographic belt, which contributes to stable formation of a high-quality electrophotographic image under various environments. Another aspect of the present disclosure is directed to providing an electrophotographic image forming apparatus that can form a high-quality electrophotographic image.

According to one aspect of the present disclosure, there is provided an electrophotographic belt having a biaxially stretched cylindrical film as a base layer. The biaxially stretched cylindrical film includes crystalline polyester, amorphous polyester and carbon black. A content of the carbon black with respect to the biaxially stretched cylindrical film is 2.0% by mass or more, and a surface resistivity measured on the surface of the biaxially stretched cylindrical film in an environment of a temperature of 23° C. and a relative humidity of 50% is $1\times10^3$ Ω/square or higher and $1\times10^{13}$ Ω/square or lower. Further, A/B is 3.00 or smaller, where A (Ω/square) represents a surface resistivity measured on the surface of the biaxially stretched cylindrical film after the biaxially stretched cylindrical film is left to stand for 24 hours in an environment of a temperature of 23° C. and a relative humidity of 50%, and B (Ω/square) represents a surface resistivity measured on the surface of the biaxially stretched cylindrical film after the biaxially stretched cylindrical film is left to stand for 24 hours in an environment of a temperature of 30° C. and a relative humidity of 80%.

According to another aspect of the present disclosure, there is provided an electrophotographic image forming apparatus including the electrophotographic belt as an intermediate transfer belt.

Further features of the present disclosure will become apparent from the following description of exemplary embodiments with reference to the attached drawings.

BRIEF DESCRIPTION OF THE DRAWINGS

FIGS. 5A, 5B-1, 5B-2 and 5B-3 illustrate explanatory diagrams of a configuration example of the electrophotographic belt according to the present disclosure.

DESCRIPTION OF THE EMBODIMENTS

Figure 1:
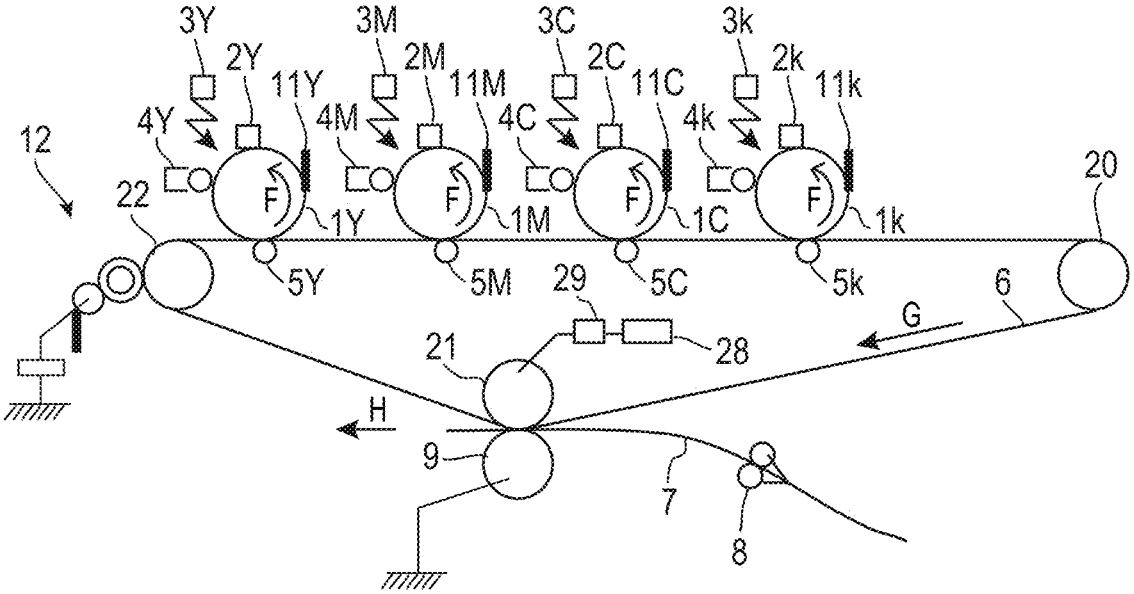
FIG. 1 illustrates a schematic cross-sectional view illustrating an example of a full-color electrophotographic image forming apparatus that uses an electrophotographic process.

Preferred embodiments of the present disclosure will now be described in detail (in accordance with the accompanying drawings).

In the present disclosure, the descriptions of "XX or more and YY or less" and "XX-YY" which indicate numerical ranges mean numerical ranges including a lower limit and an upper limit, which are endpoints, unless otherwise specified. When numerical ranges are described in stages, the upper limit and the lower limit of each numerical range can be arbitrarily combined. In addition, in the present disclosure, "Ω/square" which is a unit of surface resistivity means "Ω/square".

According to the invention of Japanese Patent Application Laid-Open No. 2006-233150, a biaxially stretched cylindrical film excellent in strength can be obtained even from a preform containing a large amount of carbon black. However, in a case where "Pelestat 6321" which is a thermoplastic elastomer is not used so as to suppress an environmental change of the surface resistance, it has become difficult to biaxially stretch the preform itself. On the other hand, when the content of carbon black in the preform is reduced, a biaxially stretched cylindrical film can be produced, but the surface resistance is extremely high, and it has been difficult to use the film as an intermediate transfer belt for electrophotography. This is considered to be caused by the following reasons. The electroconductivity due to an electron conductive agent such as carbon black is exhibited by the formation of a conductive pathway by the electron conductive agent. However, in a biaxially stretched cylindrical film which is obtained from a preform having a small content of carbon black in the preform, the conductive path of the electron conductive agent is divided in the process in which the preform is stretched in biaxial directions of the longitudinal direction and the circumferential direction. It is considered that as a result, sufficient electroconductivity has not been exhibited.

Then, the present inventors have repeatedly studied to obtain a biaxially stretched cylindrical film having a conductive path due to the electron conductive agent, while suppressing the content of the electron conductive agent. As a result, it has been found that the conductive path due to carbon black can be formed in a biaxially stretched cylindrical film, with the use of crystalline polyester and amorphous polyester in combination as a binder.

The present inventors assume the reason why by the use of the crystalline polyester and the amorphous polyester in combination as a binder, the conductive path due to the carbon black can be formed in the biaxially stretched cylindrical film, in the following way. The carbon black which is contained in the preform containing the crystalline thermoplastic resin acts as a crystal nucleus of the crystalline thermoplastic resin. Because of this, when the carbon black is dispersed directly in the crystalline thermoplastic resin, the carbon black becomes a crystal nucleus in the process of biaxial stretching, and promotes production of spherical crystals of the crystalline thermoplastic resin.

It is considered that the spherical crystals aggregate and grow, thereby the conductive path of the carbon black is divided, and the electroconductivity resists being exhibited.

However, when the binder includes the amorphous polyester, the amorphous polyester phase can allow the carbon black to be a state of being unevenly distributed therein. The carbon black in the amorphous polyester phase does not come in direct contact with the crystalline polyester, and accordingly spheroidization of the crystalline polyester is suppressed in the process of the biaxial stretching. On the other hand, the amorphous polyester is incompatible with the crystalline polyester, but both of the polyesters have ester bonds, and accordingly have relatively high affinity; and resist causing breakage at the interface between the amorphous polyester phase and the crystalline polyester phase, even in the process of the biaxial stretching. As a result, the amorphous polyester phase is stretched in biaxial directions in a state of containing the carbon black. Because of this, it is considered that in the biaxially stretched cylindrical film which is obtained by the biaxial stretching, the conductive path of the carbon black is formed in the amorphous polyester phase stretched in the biaxial directions. Because of this, it is considered that the environmental dependency of the surface resistance can be reduced. In addition, the crystalline polyester is stretched in the longitudinal direction and the circumferential direction of the preform, thereby crystals are oriented in each direction, and the biaxially stretched cylindrical film has an excellent strength.

The electrophotographic belt according to one aspect of the present disclosure will be described in detail below. Note that the present disclosure is not limited to the following aspects.

<Thermoplastic Resin Composition>

<Electrophotographic Belt>

The electrophotographic belt according to the present disclosure has a biaxially stretched cylindrical film as a base layer.

Figure 2:
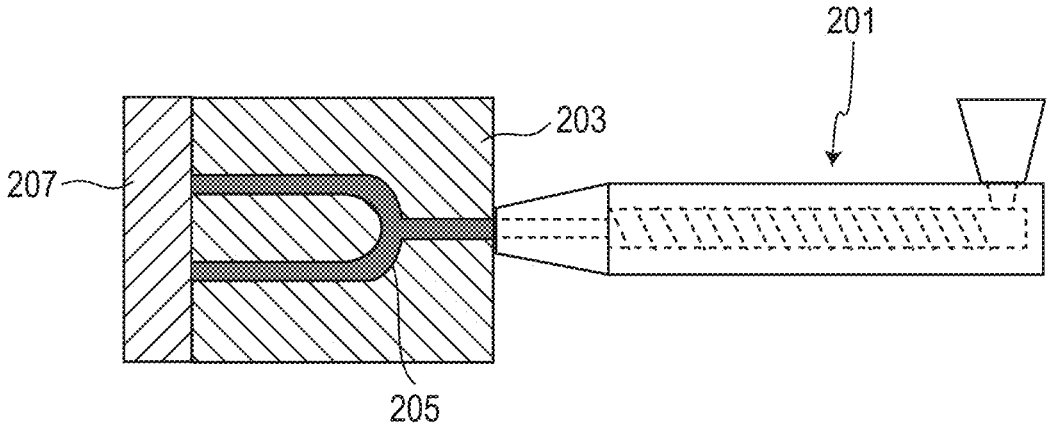
FIG. 2 is a schematic cross-sectional view of an injection molding apparatus which has been used in Example.
Figure 5A:
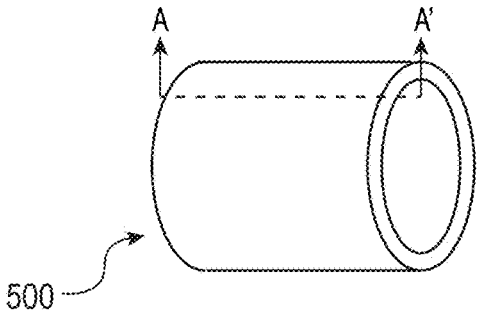
Figures 1, 5B:
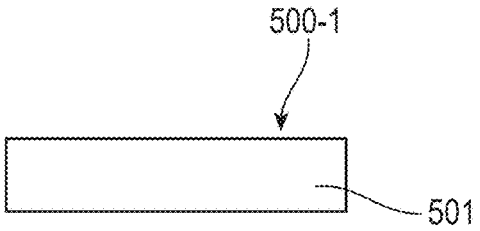
Figures 2, 5B:
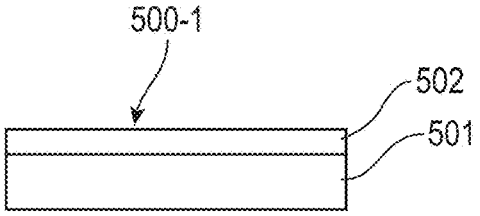
Figures 3, 5B:
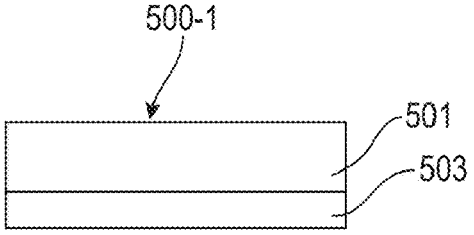

FIG. 5A illustrates a perspective view of an electrophotographic belt 500, which has an endless belt shape, according to one aspect of the present disclosure. An example of the layer structure includes a monolayer structure that is composed of only a base layer 501 in a cross section taken along the line A-A' of FIG. 5, as illustrated in FIG. 5B-1. In this case, an outer surface 500-1 of the base layer becomes a toner carrying surface (outer surface) of the electrophotographic belt. Another example includes an electrophotographic belt having a layered structure that includes the base layer 501 and a surface layer 502 which covers an outer peripheral surface of the base layer, in the cross section taken along the line A-A', as illustrated in FIG. 5B-2. In the case where the surface layer 502 is provided, the outer surface 500-1 of the surface layer 502 becomes the toner carrying surface of the electrophotographic belt. Further another example includes an electrophotographic belt having a layered structure that includes the base layer 501 and a back surface layer 503 which covers an inner peripheral surface of the base layer, as illustrated in FIG. 5B-3. Furthermore, there is also an electrophotographic belt having a three-layer structure (unillustrated) that includes the surface layer which covers the outer peripheral surface of the base layer 501 and the back surface layer which covers the inner peripheral surface of the base layer 501.

<Base Layer>

The biaxially stretched cylindrical film constituting the base layer includes a crystalline polyester, an amorphous polyester, and carbon black. A content of the carbon black with respect to the biaxially stretched cylindrical film is 2.0% by mass or more.

The surface resistivity measured on the outer surface of the biaxially stretched cylindrical film under an environment of a temperature of 23° C. and a relative humidity of 50% is $1.0\times10^{3}$ Ω/square or higher and $1.0\times10^{13}$ Ω/square or lower. In the case where the electrophotographic belt is used as the intermediate transfer belt, for example, the transfer electric field at the time of the secondary transfer can be easily obtained due to the surface resistivity set to $1.0\times10^{3}$ Ω/square or higher. Then, the occurrence of a defect in an image (missing of image, roughness, or the like) can be effectively suppressed, which originates in the secondary transfer. In addition, due to the surface resistivity set to $1.0\times10^{13}$ Ω/square or lower, it can be more effectively suppressed that the transfer voltage becomes excessive, and it can be effectively suppressed that a power source becomes large and the cost increases.

In addition, A/B is 3.00 or smaller, where A (Ω/square) represents a surface resistivity measured on the outer surface of the biaxially stretched cylindrical film after the biaxially stretched cylindrical film is left to stand for 24 hours in an environment of a temperature of 23° C. and a relative humidity of 50%, and B (Ω/square) represents a surface resistivity measured on the outer surface of the biaxially stretched cylindrical film after the biaxially stretched cylindrical film is left to stand for 24 hours in an environment of a temperature of 30° C. and a relative humidity of 80%. Thus, in the biaxially stretched cylindrical film according to the present disclosure, the environmental dependency of the surface resistance on the outer surface thereof is extremely small. As described above, in the electrophotographic belt according to the present disclosure, the surface resistance does not largely change even under a high-temperature and high-humidity environment or a low-temperature and low-humidity environment, which accordingly results in contributing to stable formation of a high-quality electrophotographic image. A/B may preferably be 0.33 or more and 3.00 or less, more preferably be 1.00 or more and 3.00 or less, and further preferably be 1.00 or more and 1.30 or less.

The thickness of the biaxially stretched cylindrical film according to the present disclosure is not particularly limited. However, the biaxially stretched cylindrical film is arranged in an inflected state in the electrophotographic image forming apparatus, and accordingly, it is preferable to control the thickness to 40 μm to 500 μm, and particularly to 50 μm to 100 μm, from the viewpoint of ensuring the flexibility. In addition, it is preferable that a tensile elastic modulus Ep in the circumferential direction and a tensile elastic modulus Ea in the direction orthogonal to the circumferential direction of the biaxially stretched cylindrical film are both 1000 MPa or higher. As described above, the electrophotographic belt is stretched by a predetermined tension due to a plurality of rollers in the electrophotographic image forming apparatus, but elongation and breakage can be prevented by the Ep set to 1000 MPa or higher. In addition, due to the predetermined tension applied in the circumferential direction, a compressive force is applied in the direction orthogonal to the circumferential direction of the electrophotographic belt. However, by the Ea set to 1000 MPa or higher, it can be more reliably suppressed that wrinkles on the outer surface of the electrophotographic belt are formed along the circumferential direction by the compressive force.

The tensile elastic modulus as described above can be controlled by the orientation of the crystalline polyester in the circumferential direction and the direction orthogonal to the circumferential direction of the biaxially stretched cylindrical film. In addition, a degree of orientation of the crystalline polyester can be represented by a shrinkage factor αp in the circumferential direction of the biaxially stretched cylindrical film and a shrinkage factor αa in the direction orthogonal to the circumferential direction. In addition, it is preferable that both of the αp and the αa of the biaxially stretched cylindrical film are 2.0% or higher. The biaxially stretched cylindrical film having the αp and αa of 2.0% or higher means that the crystalline polyester is sufficiently oriented in the circumferential direction and the direction orthogonal to the circumferential direction, and when the belt is stretched, a shrinkage stress works, and thereby can suppress the deformation of the belt. In addition, the biaxially stretched cylindrical film having such a shrinkage factor can set the above tensile elastic modulus Ep and Ea to 1000 MPa or higher. For information, methods for measuring Ep and Ea and αp and αa will be described in detail in Example.

<Crystalline Polyester>

The crystalline polyester can be obtained by polycondensation of a dicarboxylic acid and a diol, polycondensation of an oxycarboxylic acid or lactone, polycondensation with the use of a plurality of these components, or the like. It is also acceptable to further use a polyfunctional monomer in combination. The crystalline polyester may be a homopolyester containing one type of ester bond, or a copolyester (copolymer) containing a plurality of ester bonds.

Preferable examples of the crystalline polyester include at least one selected from the group consisting of a polyalkylene terephthalate and a polyalkylene naphthalate which have high crystallinity and exhibit excellent heat resistance. In addition, a copolymer of a polyalkylene naphthalate and a polyalkylene isophthalate can be preferably used.

The numbers of carbon atoms of alkylenes in the polyalkylene terephthalate, the polyalkylene naphthalate and the polyalkylene isophthalate are each preferably 2 or more and 16 or less, from the viewpoint of high crystallinity and heat resistance. More specifically, as the crystalline polyester, the polyethylene terephthalate (PET), the polyethylene naphthalate (PEN), polyethylene isophthalate, and copolymers containing these components are preferable. These may be used singly, or in combinations of two or more thereof. A molecular weight of the crystalline polyester is not particularly limited, but for example, in the case of PET, the preferable weight average molecular weight is 50000 (fifty thousand) to 80000 (eighty thousand). In addition, in the case of PEN, the preferable weight average molecular weight is 20000 (twenty thousand) to 80000 (eighty thousand).

The content ratio of the crystalline polyester in the biaxially stretched cylindrical film is preferably 50.0% by mass or more, and is more preferably 60.0% by mass or more, with respect to the total mass of the thermoplastic resin composition. When the content ratio of the crystalline polyester is within the above range, a sufficient amount of the crystalline polyester can be oriented in the circumferential direction and the direction orthogonal to the circumferential direction of the biaxially stretched cylindrical film, and the mechanical strength of the biaxially stretched cylindrical film can be more reliably enhanced.

<Amorphous Polyester>

Examples of the amorphous polyester include a polyester having a monomer unit derived from at least one phthalic acid selected from the group consisting of terephthalic acid, orthophthalic acid and isophthalic acid, and a monomer unit derived from at least two diols selected from the group consisting of ethylene glycol, diethylene glycol, propylene glycol, neopentyl glycol and cyclohexanedimethanol.

Examples include: a polycondensate of a copolymer having an ethylene terephthalate unit and an ethylene orthophthalate unit and the above diol; and a polycondensate of a copolymer having the ethylene terephthalate unit and an ethylene isophthalate unit and the above diol. These copolymers may be any one of block and random copolymers. In addition, it is also acceptable to use a mixture in which two or more copolymers are blended or alloyed.

Examples of the amorphous polyester that can be suitably used include an amorphous polyester having a monomer unit derived from terephthalic acid, and each of monomer units of ethylene glycol and propylene glycol. Such an amorphous polyester is commercially available, for example, as "VYLON® GK640" and "VYLON® GK880" (both trade names, produced by Toyobo Co., Ltd.).

The chemical structure of the amorphous polyester resin can be identified by extracting the amorphous polyester from the base layer by an appropriate unit such as dissolution in a solvent such as toluene or methyl ethyl ketone, then isolating the extracted amorphous polyester, and using thermal decomposition GC/MS, IR, NMR, or elemental analysis.

It is preferable that the content of the amorphous polyester is 10.0% by mass or more and 100.0% by mass or less, and is particularly 15.0% by mass or more and 35.0% by mass or less, with respect to the content of the crystalline polyester. When the content of the amorphous polyester with respect to the crystalline polyester is within the above range, an amorphous polyester phase which contains the conductive paths due to the carbon black in a sufficient amount for exhibiting the surface resistance value described above can be formed in the biaxially stretched cylindrical film.

<Carbon Black>

Examples of carbon blacks that can be used in the present disclosure include, for example, acetylene black, furnace black, channel black and thermal black. These may be used singly, or in combinations of two or more thereof.

Among the above carbon blacks, the carbon blacks are preferably used which can form a developed connection state, such as Ketjen Black (registered trademark). The connection state of carbon black can be evaluated by an amount of DBP absorption. The amount of DBP absorption is a parameter representing a complex aggregation form (structure) due to chemical or physical bonding between carbon black particles, and is expressed by an amount (mL) of dibutyl phthalate (DBP) that can be included per 100 g of carbon black.

In carbon black having a large amount of DBP absorption, the structure is more developed. Because of this, the carbon black having a large amount of DBP absorption, which is dispersed in the resin, can enhance the electroconductivity of the obtained resin composition. In addition, as the structure of the carbon black is more developed, an effect of the crystal nucleation by the carbon black decreases, and the arrangement of the molecules of the crystalline polyester is obstructed. In other words, crystallization of the crystalline polyester can be relatively suppressed. Accordingly, the present inventors consider that the production of spherical crystals of the crystalline polyester can be relatively suppressed by use of carbon black having a high structure, and that the biaxial stretch formability of the resin composition can be better maintained even when a high concentration of carbon black is contained in the resin composition. For this reason, it is preferable that the amount of DBP absorption of the carbon black is 300 mL/100 g or more. The amount of DBP absorption of the carbon black in the base layer can be measured, for example, by the following method of: eluting the amorphous polyester from the base layer with the use of a solvent or the like; extracting carbon black existing in a phase of the amorphous polyester; and measuring the carbon black with the use of a well-known measuring apparatus for the amount of DBP absorption.

The content of carbon black in the base layer shall be 2.0% by mass or more with respect to the mass of the base layer, from the viewpoint of imparting a predetermined electroconductivity to the base layer. It is preferable that the upper limit is 15.0% by mass or smaller, from the viewpoint of the strength of the biaxially stretched cylindrical film. The content of carbon black may preferably be 2.0 to 15.0% by mass. In addition, it is preferable that the content of the carbon black with respect to the mass of the amorphous polyester in the base layer is in the range of 8.0 to 35.0% by mass. Due to the ratio of the carbon black with respect to the mass of the amorphous polyester set within the above range, the conductive path due to the carbon black can be reliably formed in the phase of the amorphous polyester, and the surface resistance of the base layer can be easily adjusted within the above range.

<Additive Agent>

Other components may be added to the thermoplastic resin composition in such a range that the effects of the present disclosure are not impaired. Examples of the other components include an antioxidant, an ultraviolet absorber, an organic pigment, an inorganic pigment, a pH adjuster, a crosslinking agent, a compatibilizer, a mold release agent, a coupling agent and a lubricant. These additive agents may be used singly, or in combinations of two or more thereof.

The amount of the additive agent to be used can be appropriately set, and is not particularly limited.

In addition, the base layer may contain an ion conductive agent in such a range as not to impair one of the effects according to the present disclosure, for example, an effect of suppressing a change in the surface resistance by an environment. For example, in the case where the base layer contains the ion conductive agent, it is preferable that the total amount of the ion conductive agent is 2.0% by mass or less, on a base of the mass of the base layer. Due to the content ratio of the ion conductive agent set to 2.0% by mass or less, the environmental dependency of the surface resistance of the base layer can be controlled to be an almost negligible degree. However, in the present disclosure, it is more preferable that the biaxially stretched cylindrical film is free of the ion conductive agent.

<Surface Layer>

Examples of the surface layer include a layer which contains a cured product of an active energy ray-curable resin and is excellent in abrasion resistance. Such a second layer can be provided, for example, by applying a composition containing an active energy ray-curable resin such as a photocurable resin on the outer peripheral surface of the base layer, and curing the composition. The thickness of the surface layer is not particularly limited, but is preferably 1 to 5 μm, for example.

<Back Surface Layer>

Examples of the back surface layer include: a resin layer for reinforcing the base layer; and an electroconductive layer for making the inner peripheral surface of the electrophotographic belt electroconductive. The thickness of the back surface layer is not particularly limited, but is preferably 0.05 to 10 μm, for example.

<Method for Producing Base Layer>

The biaxially stretched cylindrical film can be produced, for example, through the following steps (i) to (iii).

Step (i): obtaining a preform that is formed from a resin mixture containing a crystalline polyester, an amorphous polyester and carbon black, and has a test tube shape.

Step (ii): stretching the preform in the longitudinal direction and also biaxially stretch forming the preform in the longitudinal direction and the circumferential direction by introducing a gas into the preform (biaxial stretch blow forming), and obtaining a biaxial stretch formed product (hereinafter, also referred to as "bottle").

Next, step (iii): cutting both ends of the bottle and obtaining a biaxially stretched cylindrical film having an endless shape.

Regarding the step (i), first, a pellet of a resin mixture is prepared which contains a crystalline polyester, an amorphous polyester and carbon black.

At this time, it is preferable to prepare the pellet of the resin mixture by firstly melt-kneading the noncrystalline polyester and carbon black and thereby preparing an amorphous polyester mixture, then mixing the amorphous polyester mixture and the crystalline polyester, and further, subjecting the mixture to hot melt kneading.

Thereby, the carbon black can be more reliably unevenly distributed in the amorphous polyester. Specifically, as described above, in the biaxially stretched cylindrical film according to the present disclosure, it is preferable to unevenly distribute the carbon black in the phase of the amorphous polyester, and allow the carbon black not to come in direct contact with the crystalline polyester. Thereby, the production of the spherical crystals of the crystalline polyester at the time of biaxial stretching can be prevented, the formation of the conductive path of carbon black from can be prevented from being obstructed, and the conductive path of carbon black can be more reliably formed in the phase of the amorphous polyester.

It is to be noted that, when two or more crystalline polyesters are used as the crystalline polyester, it is preferable to subject the two or more crystalline polyesters to hot melt kneading, and prepare a crystalline polyester mixture.

In the hot melt kneading of the crystalline polyester or the crystalline polyester mixture, and the amorphous polyester mixture, kneading at the following temperature is preferred. Specifically, in order that the polyester is adequately kneaded which has the highest melting point among the crystalline polyester and the amorphous polyester to be contained in the resin mixture, it is preferable to knead the resultant mixture at a temperature of the highest melting point or higher. The kneading method is not particularly limited, and a single-screw extruder, a twin-screw kneading extruder, a Banbury mixer, a roll, Brabender, plastograph, a kneader and the like can be used.

A preform having a test tube shape is molded with the use of the thus obtained resin mixture. The method for molding the preform is not particularly limited, and examples thereof include the following methods. As illustrated in FIG. 2, a method of molding a preform 205 having a predetermined shape, by injecting a molten material of the resin mixture into a mold for molding the preform, which includes a cavity mold 203 and a core mold 207, with the use of an injection molding apparatus 201, and solidifying the molten material in the mold for molding the preform. For information, at this time, it is preferable to set the temperature of the mold for molding the preform into which the molten material is injected, to 40° C. or lower, for example. The molten material injected into the mold is cooled and solidified in the mold, and rapid cooling at this time can prevent the crystallization of the crystalline polyester from proceeding.

Due to the crystallization of the crystalline polyester being suppressed in the preform, the crystal orientation of the crystalline polyester in the biaxial directions can be more accurately controlled in the stretch blow forming in the step (ii).

Figure 3A:
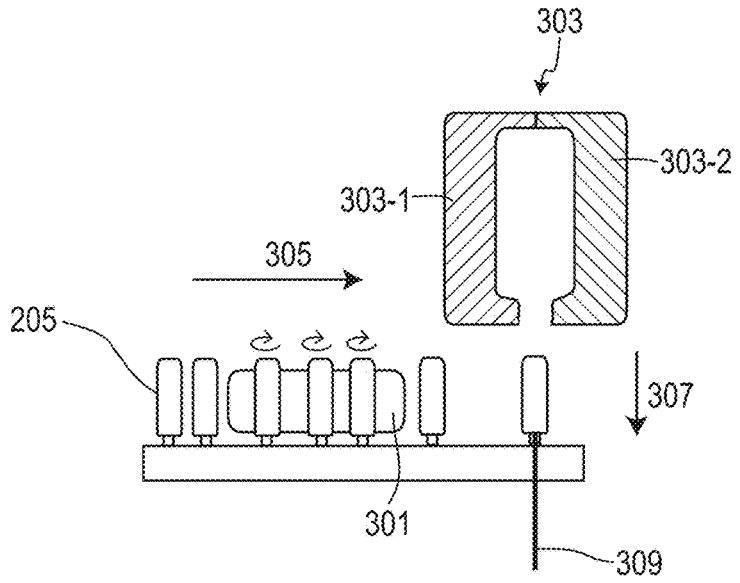
FIGS. 3A, 3B, 3C and 3D illustrate schematic cross-sectional views of a primary blow forming apparatus which has been used in Example.
Figure 3B:
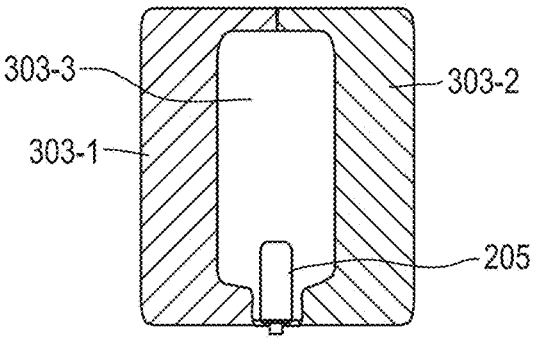

Next, in the step (ii), the preform is subjected to biaxial stretch blow forming. Firstly, as illustrated in FIG. 3A, the preform 205 is placed in a heating furnace 301 and heated to a temperature at which the preform 205 can be stretched. The heating time at this time is preferably within 1 minute. Due to the heating time set to 5 minutes or shorter, it can be prevented that the crystallization of the crystalline polyester proceeds in the preform during heating. The heated preform is conveyed in the direction of the arrow 305. Next, a blow die 303 is lowered in the direction of the arrow 307 from directly above the heated preform 205, which has the cylindrical cavity 303-3 formed therein by the combination of a left side mold 303-1 and a right-side mold 303-2. Then, as illustrated in FIG. 3B, the preform 205 is arranged at a mouth portion of the blow die 303.

It is preferable to place the heated preform at the mouth portion of the blow die in a short time (for example, within 20 seconds) so that the temperature of the heated preform does not drop before the start of the next biaxial stretching step. Thereby, it can be prevented that the crystallization of the crystalline polyester in the preform proceeds due to slow cooling of the preform. For information, it is acceptable to calculate a heating temperature of the preform previously by checking an endothermic peak at the time of temperature rise or the shift of a base line, with the use of a differential scanning calorimeter (DSC) of the resin mixture which is a constituent material of the preform, or to determine the heating temperature from the glass transition temperature (Tg).

Figure 3C:
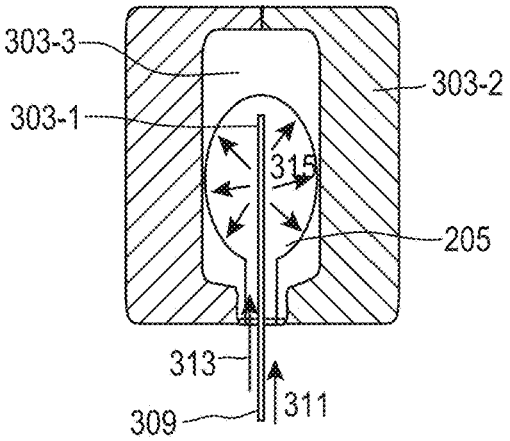

As illustrated in FIG. 3C, a stretching rod 309 is driven in the direction of the arrow 311, and thereby stretches the heated preform 205 which has been placed in the blow die 303, in the longitudinal direction of the preform 205. This stretching is referred to as primary stretching. In addition, in synchronization with the driving of the stretching rod 309, a gas is caused to flow into the preform from a mouth portion of the preform 205 (arrow 313), and expands the preform in its circumferential direction. This operation is referred to as secondary stretching. Examples of the gas to be blown include air, nitrogen, carbon dioxide and argon. As a result, the preform 205 expands in each direction indicated by the arrows 315 in FIG. 3C, comes into close contact with the inner wall of the cavity 303-3, and is cooled and solidified in the state. Next, the left mold 303-1 and the right mold 303-2 of the blow die 303 are separated, and thereby, a formed product having a bottle shape (hereinafter, also referred to as "blow bottle") is taken out from the blow die 303.

Figure 3D:
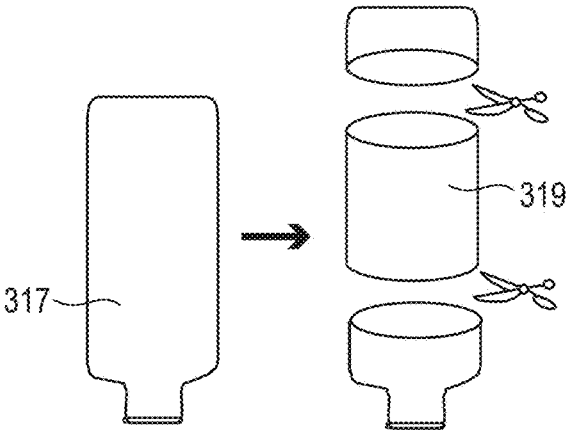

Next, as illustrated in FIG. 3D, portions of the obtained blow bottle 317 are cut down which are on the mouth portion side and on an upper end opposite to the mouth portion side, and a biaxially stretched cylindrical film 319 is obtained which becomes the base layer.

Figure 4:
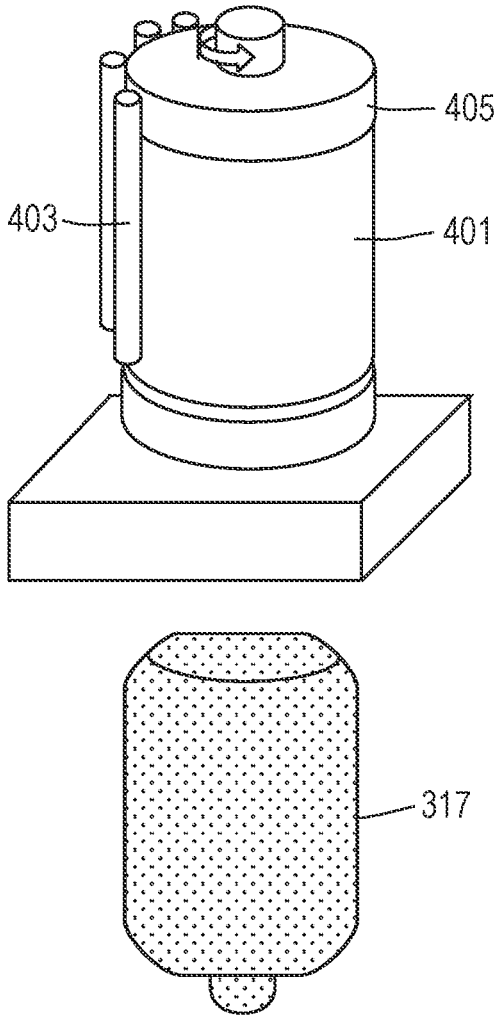
FIG. 4 illustrates a schematic cross-sectional view of a secondary blow forming apparatus which has been used in Example.

For information, it is also acceptable to subject the blow bottle 317 to heat treatment before cutting, as needed, and to adjust the surface roughness of the outer peripheral surface of the blow bottle, or finely adjust crystallinity of the crystalline polyester. Specifically, for example, as illustrated in FIG. 4, the blow bottle 317 is placed in a cylindrical die 401, and then the blow bottle is filled with a gas; and then, the upper portion and the lower portion of the die 401 are set in a state in which outer dies are respectively mounted thereon, in order that the gas in the inner part of the blow bottle does not leak out, and the die 401 is heated while the die 401 is rotated by a roller-shaped heater 403 which is brought into contact with the outer peripheral surface of the die 401. The heating temperature is set, for example, about 130 to 190° C., and the heating time is set, for example, about 60 seconds so that the whole circumference of the blow bottle is uniformly heated.

The electrophotographic belt according to the present disclosure is not limited to applications for the intermediate transfer belt, and is also suitably used, for example, as a conveying transfer belt.

<Electrophotographic Image Forming Apparatus>

An example of an electrophotographic image forming apparatus will be described below that uses an electrophotographic belt according to one aspect of the present disclosure as the intermediate transfer belt. As illustrated in FIG. 1, this electrophotographic image forming apparatus has a configuration of a so-called tandem type in which electrophotographic stations of a plurality of colors are arranged side by side in the rotation direction of the intermediate transfer belt. In the following description, suffixes Y, M, C and k are appended to the symbols of the structures related to the colors of yellow, magenta, cyan and black, respectively, but the suffix is omitted regarding the same structure, in some cases.

In FIG. 1, charging apparatuses 2Y, 2M, 2C and 2*k*, exposure apparatuses 3Y, 3M, 3C and 3*k*, developing apparatuses 4Y, 4M, 4C and 4*k*, and an intermediate transfer belt (intermediate transfer body) 6 are arranged around photosensitive drums (photosensitive members, image carrying bodies) 1Y, 1M, 1C and 1*k*, respectively. The photosensitive drum 1 is rotationally driven in the direction of the arrow F (counterclockwise direction) at a predetermined peripheral speed (process speed). The charging apparatus 2 charges the peripheral surface of the photosensitive drum 1 to a predetermined polarity and potential (primary charging). A laser beam scanner serving as the exposure apparatus 3 outputs a laser beam which is on/off modulated in response to image information which is input from an external device such as an unillustrated image scanner or computer, and scans and exposes the charged surface on the photosensitive drum 1. By this scanning and exposure, an electrostatic latent image corresponding to the target image information is formed on the surface of the photosensitive drum 1.

The developing apparatuses 4Y, 4M, 4C and 4*k* contain toners of color components of yellow (Y), magenta (M), cyan (C) and black (k), respectively. Then, the developing apparatuses 4 to be used are selected based on the image information, a developer (toner) is developed on the surface of the photosensitive drum 1, and the electrostatic latent image is visualized as a toner image. In the present embodiment, a reverse development system is used which makes the toner adhere to the exposed portion of the electrostatic latent image in this way and develops the electrostatic latent image. In addition, the charging apparatus, the exposure apparatus and the developing apparatus constitute an electrophotographic image forming unit.

In addition, the intermediate transfer belt 6 is composed of an electrophotographic belt having an endless shape. In addition, the intermediate transfer belt 6 is stretched by a plurality of rollers 20, 21 and 22 so that the outer peripheral surface of the intermediate transfer belt 6 comes into contact with the surface of the photosensitive drums 1. In the present embodiment, the roller 20 is a tension roller structured to control the tension of the intermediate transfer belt 6 so as to be constant; the roller 22 is a driving roller of the intermediate transfer belt 6; and the roller 21 is a counter roller for secondary transfer. Then, the intermediate transfer belt 6 rotates in the direction of the arrow G by the drive of the roller 22. In addition, primary transfer rollers 5Y, 5M, 5C and 5*k* are arranged on primary transfer positions, which face the photosensitive drums 1, respectively, while sandwiching the intermediate transfer belt 6 therebetween.

Unfixed toner images of the colors, which have been formed on the photosensitive drums 1, respectively, are sequentially and electrostatically primary-transferred onto the intermediate transfer belt 6, by a primary transfer bias having a polarity opposite to the charging polarity of the toner, which is applied to the primary transfer rollers 5 by an unillustrated constant voltage source or constant current source. Then, a full-color image is obtained in which unfixed toner images of four colors are superimposed on the intermediate transfer belt 6. The intermediate transfer belt 6 rotates while carrying the toner images which have been transferred thereonto from the photosensitive drums 1 in this way. At every one rotation of the photosensitive drum 1 after the primary transfer, the transfer residual toner on the surface of the photosensitive drum 1 is cleaned by a cleaning apparatus 11, and the resultant surface repeatedly enters an image forming step.

In addition, at the secondary transfer position of the intermediate transfer belt 6, which faces the conveyance path of the recording material 7 serving as a transfer medium, a secondary transfer roller (transfer portion) 9 is press-contacted and arranged at the toner image carrying surface side of the intermediate transfer belt 6. In addition, on the back surface side of the intermediate transfer belt 6 at the secondary transfer position, there is disposed the counter roller 21 which forms a counter electrode of the secondary transfer roller 9 and to which a bias is applied. When the toner image on the intermediate transfer belt 6 is transferred to the recording material 7, a bias, for example, −1000 to −3000 V having the same polarity as that of the toner is applied to the counter roller 21 by a transfer bias application unit 28, and a current of −10 to −50 μA flows through the counter roller 21. A transfer voltage at this time is detected by a transfer voltage detecting unit 29. Furthermore, a cleaning apparatus (belt cleaner) 12 for removing the toner which remains on the intermediate transfer belt 6 after the secondary transfer is provided on the downstream side of the secondary transfer position.

The recording material 7 passes through a conveyance guide 8, is conveyed in a direction of an arrow H, and is introduced into a secondary transfer position. The recording material 7 which has been introduced into the secondary transfer position is nipped at the secondary transfer position and is conveyed; and at this time, a constant voltage bias (transfer bias) that is controlled to a predetermined value is applied to the counter roller 21 of the secondary transfer roller 9 from the secondary transfer bias application unit 28. Due to the transfer bias having the same polarity as that of the toner, which has been applied to the counter roller 21, a full-color image (toner image) of four colors that are superposed on the intermediate transfer belt 6 is transferred to the recording material 7 at the transfer portion at a time, and a full-color unfixed toner image is formed on the recording material. The recording material 7 on which the toner image has been transferred is introduced into an unillustrated fixing device, and is heated there; and the toner image is fixed.

According to one aspect of the present disclosure, an electrophotographic belt can be obtained, which contributes to stable formation of a high-quality electrophotographic image under various environments. According to another aspect of the present disclosure, an electrophotographic image forming apparatus can be obtained that can stably form the high-quality electrophotographic image.

EXAMPLES

The present disclosure will be specifically described below with reference to Examples and Comparative Examples, but the present disclosure is not limited thereto. Materials are shown below which were used for producing the electrophotographic belts according to Examples and Comparative Examples.

TABLE 1

| Abbreviation | Material name (trade name and the like) |
|---|---|
| Crystalline polyester 1 (cPES 1) | Polyethylene terephthalate (Trade name: TRN-8550FF, produced by Teijin Limited) |
| Crystalline polyester 2 (cPES 2) | Polyethylene naphthalate (Trade name: TN-8050SC, produced by Teijin Limited) |
| Ion conductive agent (IC) | Lithium bis(trifluoromethanesulfonyl)imide (Trade name: EF-N115, produced by Mitsubishi Materials Electronic Chemicals Co., Ltd.) |
| Non-conductive elastomer (ES1) | Styrene/butadiene copolymer (Trade name: Tuftec M1913, produced by Asahi Kasei Corporation) |

TABLE 2

| Abbreviation | Material name (trade name and the like) |
|---|---|
| Amorphous polyester 1 (aPES1) | Amorphous polyester (Trade name: VYLON ® GK640, produced by Toyobo Co., Ltd.) |

TABLE 2-continued

| Abbreviation | Material name (trade name and the like) |
|---|---|
| Amorphous polyester 2 (aPES2) | Amorphous polyester (Trade name: VYLON ® GK880, produced by Toyobo Co., Ltd.) |
| Carbon black 1 (CB1) | Carbon black (Trade name: Ketjen Black EC300J produced by Lion Specialty Chemicals Co., Ltd.) |
| Carbon black 2 (CB2) | Carbon black (Trade name: Ketjen Black EC600JD produced by Lion Specialty Chemicals Co., Ltd.) |
| Ion conductive elastomer (ES2) | Polyether ester amide (Trade name: Pelestat NC6321, produced by Sanyo Chemical Industries, Ltd.) |

TABLE 3

| Abbreviation | Material name (trade name and the like) |
|---|---|
| AN | Dipentaerythritol penta- and hexa-acrylate (Trade name: Aronix ® M-402, produced by Toagosei Co., Ltd.) |
| PTFE | PTFE particle (Trade name: Lubron L-2, produced by Daikin Industries, Ltd.) |
| GF | PTFE particle dispersant (Trade name: GF-300, produced by Toagosei Co., Ltd.) |
| SL | Slurry of zinc antimonate particles (Trade name: Celnax CX-Z400K, produced by Nissan Chemical corporation, 40% by mass as zinc antimonate particle component) |
| IRG | Photopolymerization initiator (Trade name: Irgacure 907, produced by BASF) |

(Methods for Measuring and Evaluating Characteristic Values)

Methods for measuring and evaluating characteristic values of electrophotographic belts according to Examples and Comparative Examples are as in the following (1) to (5).

(Evaluation 1) Evaluation of Surface Resistivities (A, B)

The surface resistivity of a base layer of an electrophotographic belt was measured by a method according to JIS-K6911. As a measuring apparatus, a high resistance meter (trade name: Hiresta UP MCP-HT450 type, manufactured by Mitsubishi Chemical Analytech Co., Ltd.) was used, in which an inner diameter of the main electrode was 50 mm, an inner diameter of the guard ring electrode was 53.2 mm, and an outer diameter of the probe (trade name: UR-100 manufactured by Mitsubishi Chemical Analytech Co., Ltd.) was 57.2 mm. The surface resistivity is indicated as a surface resistance value per unit area (1 $cm^2$) of the electrophotographic belt, and the unit is expressed by [Ω/square].

The produced base layer of the electrophotographic belt was left to stand for 24 hours in an environmental test room in which a temperature was controlled to 23° C. and a relative humidity was controlled to 50%. After that, a voltage of 250 V was applied to the electrophotographic belt for 10 seconds under an environment of a temperature of 23° C. and a relative humidity of 50%, and the surface resistivity of the base layer of the electrophotographic belt was measured at four points in the circumferential direction. The average value of the obtained surface resistivities was defined as an index A of the surface resistivity under normal temperature and normal humidity.

Similarly, the produced base layer of the electrophotographic belt was left to stand for 24 hours in an environmental test room in which a temperature was controlled to 30° C. and a relative humidity was controlled to 80%. After that, a voltage of 250 V was applied to the base layer of the electrophotographic belt for 10 seconds under an environment of a temperature of 30° C. and a relative humidity of 80%, and the surface resistivity of the base layer of the electrophotographic belt was measured at four points in the circumferential direction. The average value of the obtained surface resistivities was defined as an index B of the surface resistivity under high temperature and high humidity.

Furthermore, A/B (times) was calculated from the obtained A and B, and was used as an index of change in the surface resistance value due to the temperature and humidity.

(Evaluation 2) Evaluation of Tensile Elastic Moduli (Ep, Ea)

The tensile elastic modulus was measured with the use of a universal material testing machine for low load (trade name: 34TM-5, manufactured by Instron) in which a load cell of 5 kN was incorporated, in an environment of a temperature of 23° C. and a relative humidity of 50%. Sample pieces of 100 mm in the circumferential direction of the belt×20 mm in the longitudinal direction, and 20 mm in the circumferential direction of the belt×100 mm in the longitudinal direction were cut out from the produced electrophotographic belt, and the sample piece was gripped by a pneumatic grip of which the distance between the chucks was set to 50 mm. The gripped sample piece was pulled at a constant speed of 5 mm/min, and from the obtained stress-strain curve and the thickness of the electrophotographic belt, the tensile elastic modulus was calculated based on the stress value at 0.25% strain. Average values were determined from the measurement results of each of five sample pieces cut out from the same electrophotographic belt; and a tensile elastic modulus in the circumferential direction of the electrophotographic belt was defined as Ep, and a tensile elastic modulus in the direction orthogonal to the circumferential direction was defined as Ea.

(Evaluation 3) Evaluation of Shrinkage Factor (αp, αa)

As an index of the shrinkage stress of the electrophotographic belt, the shrinkage factor was measured by the following method. The shrinkage factor was measured with the use of a thermomechanical analysis apparatus (trade name: TMA/SDTA841 type; manufactured by Mettler Toledo) under the following measurement conditions, while a change in the inter-chuck distance was regarded as a dimensional change of the sample.

Sample pieces of 5 mm in the circumferential direction of the belt×20 mm in the longitudinal direction, and 20 mm in the circumferential direction of the belt×5 mm in the longitudinal direction were cut out from the produced electrophotographic belt, and used.

The sample pieces were gripped so that a distance between chucks becomes 10 mm and a load becomes 0.01 N, were held at 25° C. for 10 minutes, were heated at 5° C./minute to a temperature higher than the glass transition temperature of the thermoplastic resin composition by 10° C., held for 30 minutes, and then lowered again to 25° C. at 5° C./minute.

When the distance between the chucks before the temperature rise is represented by x1 and the distance between the chucks at the end is represented by x2, the shrinkage factor α (unit: %) was calculated according to the following equation.

$$\alpha=(x1-x2)/x1\times100$$

Average values were determined from the measurement results of each of five sample pieces cut out from the same electrophotographic belt and the average values were defined as a shrinkage factor αp in the circumferential direction and a shrinkage factor αa in the direction orthogonal to the circumferential direction of the electrophotographic belt, respectively. For information, when expansion occurred, the value of the shrinkage factor was expressed as a minus sign.

(Evaluation 4) Evaluation of Amount of DBP Absorption

The amount of DBP absorption of carbon black contained in the produced electrophotographic belt was measured by the following method. One hundred sheets of sample pieces of 2 mm×2 mm were cut out from the electrophotographic belt, and pulverized; the products were immersed in toluene heated to a temperature of 50° C., and left to stand for 48 hours; and thereby, the amorphous polyester in the sample pieces was dissolved, and carbon black contained in the amorphous polyester phase was extracted. The carbon black was filtered from the solution and was subjected to the measurement of the amount of DBP absorption with the use of an absorption amount measuring apparatus (trade name: S-500; manufactured by ASAHI SOUKEN CORPORATION). Specifically, 10 g of the collected carbon black was charged into a measuring chamber, a dropping speed of DBP (dibutyl phthalate) was set to 4 mL/min, a rotation speed of a rotor blade was set to 125 rpm, and the torque was measured. The amount of DBP absorption can be defined by an amount of dropped DBP and the amount of the sample, at the time when the torque has reached 70% of the peak torque value.

It is to be noted that, when the amount of carbon black necessary for measurement of the amount of DBP absorption cannot be obtained from 100 sheets of sample pieces, it is acceptable to increase the number of samples to be collected, perform the above operation, and thereby obtain a necessary amount of carbon black.

(Evaluation 5) Digital Reproducibility of Electrophotographic Image Forming Apparatus (Evaluation of Scattered Image)

An electrophotographic image forming apparatus having the structure illustrated in FIG. 1 was used, an intermediate transfer belt serving as an electrophotographic belt was mounted therein, and the resultant apparatus was left to stand in an environmental test room which was controlled at a temperature of 30° C. and a relative humidity of 80%, for 24 hours. After that, an unfixed image at the time when a thin line image (30 lines/5 mm) was transferred onto paper was output, the unfixed image was fixed with the use of an oven at 100° C. without being pressurized, and an image was obtained. The image was observed with the use of a loupe, and the number of the thin line images was evaluated in which scattering of toner occurred.

Example 1

(Production of Base Layer)

<Preparation of Amorphous Polyester Mixture>

A preblended sample was prepared in which aPES1 and CB1 in Table 2 were mixed at a compounding ratio shown in Table 4. The preblended sample was hot-melt kneaded with the use of a twin-screw extruder (trade name: TEX30α, manufactured by Japan Steel Works, Ltd.), and an amorphous polyester mixture was prepared. A temperature of the hot melt kneading was adjusted so as to be within a range of 190° C. or higher and 270° C. or lower, and a time period of the hot melt kneading was set to 3 to 5 minutes. The obtained amorphous polyester mixture was pelletized and dried at a temperature of 90° C. for 10 hours.

<Preparation of Crystalline Polyester>

A pellet of cPES1 in Table 1 was dried at a temperature of 140° C. for 10 hours.

Next, the pellet of cPES1 and the pellet of the amorphous polyester mixture were charged into an injection molding apparatus (trade name: SE180D, manufactured by Sumitomo Heavy Industries, Ltd.) so as to follow a compounding ratio described in Table 4. Then, molten resin of the compounded pellets were injection molded into a mold having a test tube shape, of which the temperature was controlled to 30° C., from the cylinder of which the temperature was set to 250 to 300° C., and the preform was produced. The obtained preform had a test tube shape of which the outer diameter was 50 mm, the inner diameter was 46 mm, the length was 150 mm, and the thickness was 2 mm.

Next, the above preform was stretched in biaxial directions of the longitudinal direction and the circumferential direction, with the use of a biaxial stretch forming apparatus. Firstly, as illustrated in FIG. 3A, the preform 205 was placed in a heating apparatus 301 which was equipped with a non-contact type of heater (unillustrated) for heating the preform 205, and was heated by the heater so that the outer surface temperature of the preform became 120 to 160° C.

Next, the blow die 303 in which the die temperature was kept at 30° C. was lowered toward the heated preform 205 in the direction of the arrow 307, and the heated preform 205 was arranged in a mouth portion of the blow die 303 (FIG. 3B). Next, as illustrated in FIG. 3C, the stretching rod 309 was driven in the direction of the arrow 311, and simultaneously with the start of driving of the stretching rod, air of which the temperature was adjusted to 23° C. was introduced into the inside from the mouth portion of the preform 205 as indicated by the arrow 313 in FIG. 3C. In this way, the preform 205 was stretched in the biaxial directions, and was brought into close contact with the inner wall of the blow die. For information, the driving speed of the stretching rod 309 was set to 2.0 m/sec, and the pressure of air introduced into the inside of the blow bottle was set to 0.5 MPa.

Next, the left mold 303-1 and the right mold 303-2 of the blow die 303 were separated, and thereby, a formed product (blow bottle) 317 having a bottle shape was taken out from the blow die 303.

Next, the obtained blow bottle 317 was set in the cylindrical die 401 which was produced by an electroforming method, made from nickel, and illustrated in FIG. 4, and an outer die 405 was attached thereto. An air pressure of 0.1 MPa was applied to the blow bottle to adjust the air so as not to leak to the outside, and thereby, the outer peripheral surface of the blow bottle 317 was brought into close contact with the inner peripheral surface of the cylindrical die. Furthermore, the whole circumference of the blow bottle was uniformly heat-treated at 130 to 190° C. for 60 seconds with the use of the heater 403, while the nickel cylindrical die 401 was rotated at 2 rotations/second at a constant speed.

After that, air having a temperature of 25° C. was blown onto the cylindrical die made from nickel to cool the cylindrical die down to room temperature (25° C.), and the pressure of the air was released, which was applied to the inside of the blow bottle 317, and the blow bottle 317 was obtained of which the dimensions were improved by the annealing. Regarding the biaxial stretching magnification, from the dimensions of the preform 205 and the blow bottle 317, the transverse stretching magnification (circumferential direction) Lp was 4.0 times, and the longitudinal stretching magnification (direction orthogonal to the circumferential direction) La was 4.3 times.

Next, as illustrated in FIG. 3D, the portion of the blow bottle 317 on the mouth portion side and the portion opposite to the mouth portion side were cut, and a base layer of an electrophotographic belt was produced, of which the peripheral length was 630 mm, the width was 250 mm, and the thickness was 70 μm.

(Preparation of Coating Liquid for Surface Layer)

The acrylic resin compositions described in Table 3 were weighed at a ratio of AN/PTFE/GF/SL/IRG=66/20/1.0/12/1.0 (mass ratio in terms of solid content), and a solution which was subjected to a coarse dispersion treatment was dispersed with the use of a high-pressure emulsification dispersing apparatus (trade name: Nanovater, manufactured by Yoshida Kikai Co., Ltd.). The main dispersion treatment was performed until the 50% average particle size of the contained PTFE became 200 nm. The obtained dispersion liquid was used as the coating liquid for the surface layer.

(Formation of Surface Layer)

The base layer is fitted on the outer periphery of a cylindrical die (peripheral length of 630 mm), and the end portion thereof is sealed; and then, the resultant die is immersed in a container filled with the coating liquid for the surface layer, and is pulled up so that a relative speed between the liquid surface of the curable composition and the base layer of the electrophotographic belt becomes constant. In this way, a coating film formed from the coating liquid was formed on the surface of the base layer of the electrophotographic belt. The pulling speed (relative speed between liquid surface of curable composition and base layer of electrophotographic belt) and the solvent ratio of the curable composition can be adjusted according to a required film thickness of the surface layer.

In the present Example, the pulling speed was set to 10 to 50 mm/sec, and the film thickness of the surface layer was adjusted so as to become approximately 3 μm. In the present Example, a coating direction means a direction opposite to the direction in which the base layer of the electrophotographic belt is pulled up. In other words, the position which is firstly pulled up from the coating liquid becomes the most upstream position. The base layer of the electrophotographic belt, which was coated with the coating liquid, was removed from the cylindrical die, and dried in an environment of 23° C. under exhaust air for 1 minute. The drying temperature and drying time are appropriately adjusted depending on the solvent type, the solvent ratio and the film thickness.

After that, the coating film was irradiated with ultraviolet rays by use of a UV irradiation machine (trade name: UE06/81-3, manufactured by Eye Graphics Co., Ltd.) until the integrated light quantity reached 600 mJ/cm$^2$, and thereby the coating film was cured.

The thickness of the surface layer was measured by such a destructive test as to cut the base layer of the electrophotographic belt, which was separately produced under the same conditions, and observe the cross section with an electronic microscope (trade name: XL30-SFEG, manufactured by FEI Company Japan Ltd.).

As a result of the destructive test, the thickness of the surface layer was 2.8 μm. Thus, the electrophotographic belt was obtained that had a surface layer formed on the outer peripheral surface of the base layer. The electrophotographic belt was subjected to the above (Evaluation 1) to (Evaluation 5).

Examples 2 to 6, 10 and 11

Electrophotographic belts were produced in the same manner as in Example 1 except that the types and the compounding ratios of cPES, aPES and CB were as described in Table 4, and were evaluated.

Examples 7 to 9

<Preparation of Crystalline Polyester Mixture>

Preblended samples according to the respective Examples were prepared in which cPES1 and ES1 were mixed so as to follow compounding ratios described in Table 4. Each of the preblended samples was hot-melt kneaded with the use of the twin-screw extruder (trade name: TEX30α, manufactured by Japan Steel Works, Ltd.), and crystalline polyester mixtures were obtained according to the respective Examples. A temperature in the hot melt kneading was adjusted so as to become within a range of 220° C. or higher and 300° C. or lower, and a time period of the hot melt kneading was set to 3 to 5 minutes. Each of the obtained crystalline polyester mixtures was pelletized and dried at a temperature of 140° C. for 10 hours.

<Preparation of Amorphous Polyester Mixture>

Pellets of the amorphous polyester mixture according to the respective Examples 7 to 9 were prepared in the same manner as in the amorphous polyester mixture of Example 1, except that the types and the compounding ratios of aPES and CB were changed so as to follow the compounding ratios described in Table 4.

Preforms were produced in the same manner as in Example 1, except that the pellets of the crystalline polyester mixture and the pellets of the amorphous polyester mixture according to the respective Examples were used. In addition, base layers were produced and surface layers were formed in the same manner as in Example 1, except that the obtained preforms were used, and electrophotographic belts according to the respective Examples were produced. The obtained electrophotographic belts were subjected to Evaluation 1 to Evaluation 5.

Examples 12 to 16

<Preparation of Crystalline Polyester Mixture>

Preblended samples according to the respective Examples were prepared in which cPES1 and cPES2, or cPES1, cPES2 and ES1 were mixed so as to follow compounding ratios described in Table 4. These preblended samples were hot-melt kneaded with the use of the twin-screw extruder (trade name: TEX30α, manufactured by Japan Steel Works, Ltd.), and crystalline polyester mixtures were obtained according to the respective Examples. The temperature in the hot melt kneading was adjusted so as to become within a range of 220° C. or higher and 300° C. or lower, and a time period of the hot melt kneading was set to 3 to 5 minutes. Each of the obtained crystalline polyester mixtures was pelletized and dried at a temperature of 140° C. for 10 hours.

<Preparation of Amorphous Polyester Mixture>

Pellets of the amorphous polyester mixtures according to the respective Examples were prepared in the same manner as in the amorphous polyester mixture of Example 1, except that aPES1, aPES2, and CB1 or CB2 were changed so as to follow the compounding ratios described in Table 4.

Next, preforms were produced in the same manner as in Example 1, except that the pellets of the crystalline polyester mixture and the pellets of the amorphous polyester mixture according to the respective Examples were used so as to follow the compounding ratios described in Table 4. In addition, base layers were produced and surface layers were formed in the same manner as in Example 1, except that the obtained preforms were used, and electrophotographic belts according to the respective Examples were produced. The obtained electrophotographic belts were subjected to Evaluation 1 to Evaluation 5.

Examples 17 to 19

<Preparation of Crystalline Polyester Mixture>

Preblended samples according to the respective Examples were prepared in which cPES1 and IC were mixed so as to follow compounding ratios described in Table 4. Each of the preblended samples was hot-melt kneaded with the use of the twin-screw extruder (trade name: TEX30α, manufactured by Japan Steel Works, Ltd.), and crystalline polyester mixtures were obtained according to the respective Examples. The temperature in the hot melt kneading was adjusted so as to become within a range of 220° C. or higher and 300° C. or lower, and a time period of the hot melt kneading was set to 3 to 5 minutes. Each of the obtained crystalline polyester mixtures was pelletized and dried at a temperature of 140° C. for 10 hours.

<Preparation of Amorphous Polyester Mixture>

Pellets of the amorphous polyester mixture were prepared in the same manner as in Examples 1 to 3.

Next, preforms were produced in the same manner as in Example 1, except that the pellets of the crystalline polyester mixture and the pellets of the amorphous polyester mixture according to the respective Examples were used. In addition, base layers were produced and surface layers were formed in the same manner as in Example 1, except that the obtained preforms were used, and thereby, electrophotographic belts according to the respective Examples were produced. The obtained electrophotographic belts were subjected to Evaluation 1 to Evaluation 5.

and the circumferential direction. For information, the amounts of DBP absorption of carbon black in the present Comparative Examples were analyzed in the same manner as that described in the Evaluation 4 described in Example 1, except that pulverized products of the samples were used which were collected from the preforms subjected to the biaxial stretch forming.

Comparative Examples 3 and 4

Preblended samples according to the respective Comparative Examples were prepared in which aPES1 and CB1 were mixed at compounding ratios described in Table 5. Pellets of the amorphous polyester mixture were obtained in the same manner as in Example 1, except that these preblended samples were used. Preforms were produced in the same manner as in Example 1, except that only the pellets of the amorphous polyester mixture were used. Next, the preforms were subjected to biaxial stretch forming in the same manner as in Example 1.

As a result, the preforms were stretched in the longitudinal direction and the circumferential direction, but excessively stretched portions were locally generated, and the preforms were broken at the portions. Because of this, blow bottles could not be obtained. This is considered to be because the binder resins consist of amorphous polyester, and accordingly the preforms have been too soft. For information, the amounts of DBP absorption of carbon black in the present Comparative Examples were analyzed in the same manner as that described in the Evaluation 4 described in Example 1, except that pulverized products of the samples

TABLE 4

| Material abbreviation | Examples | | | | | | | | | | | | | | | | | | |
|---|---|---|---|---|---|---|---|---|---|---|---|---|---|---|---|---|---|---|---|
| Abbreviation | 1 | 2 | 3 | 4 | 5 | 6 | 7 | 8 | 9 | 10 | 11 | 12 | 13 | 14 | 15 | 16 | 17 | 18 | 19 |
| cPES 1 (mass %) | 78.0 | 68.0 | 56.0 | 75.0 | 61.0 | 52.0 | 75.0 | 59.0 | 50.0 | 0.0 | 0.0 | 63.5 | 32.0 | 8.0 | 15.0 | 20.0 | 77.9 | 67.7 | 55.5 |
| cPES 2 (mass %) | 0.0 | 0.0 | 0.0 | 0.0 | 0.0 | 0.0 | 0.0 | 0.0 | 0.0 | 75.5 | 54.0 | 10.0 | 20.0 | 60.0 | 40.0 | 30.0 | 0.0 | 0.0 | 0.0 |
| aPES 1 (mass %) | 20.0 | 28.0 | 38.0 | 0.0 | 0.0 | 0.0 | 0.0 | 0.0 | 0.0 | 0.0 | 0.0 | 8.0 | 14.0 | 4.0 | 6.0 | 6.0 | 20.0 | 28.0 | 38.0 |
| aPES 2 (mass %) | 0.0 | 0.0 | 0.0 | 23.0 | 35.0 | 42.0 | 16.0 | 26.0 | 30.0 | 22.0 | 40.0 | 16.0 | 26.0 | 18.0 | 22.0 | 24.0 | 0.0 | 0.0 | 0.0 |
| CB 1 (mass %) | 2.0 | 4.0 | 6.0 | 0.0 | 0.0 | 0.0 | 0.0 | 0.0 | 0.0 | 2.5 | 0.0 | 0.0 | 8.0 | 4.0 | 0.0 | 8.0 | 2.0 | 4.0 | 6.0 |
| CB 2 (mass %) | 0.0 | 0.0 | 0.0 | 2.0 | 4.0 | 6.0 | 4.0 | 7.0 | 10.0 | 0.0 | 6.0 | 2.5 | 0.0 | 0.0 | 7.0 | 0.0 | 0.0 | 0.0 | 0.0 |
| ES 1 (mass %) | 0.0 | 0.0 | 0.0 | 0.0 | 0.0 | 0.0 | 5.0 | 8.0 | 10.0 | 0.0 | 0.0 | 0.0 | 0.0 | 6.0 | 10.0 | 12.0 | 0.0 | 0.0 | 0.0 |
| IC (mass %) | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.0 | 0.1 | 0.3 | 0.5 |

Comparative Examples 1 and 2

Preblended samples were prepared in which cPES1 and CB1 were mixed at compounding ratios described in Table 5. Pellets of the crystalline polyester mixture were obtained in the same manner as in Example 7, except that these preblended samples were used. Next, preforms were produced in the same manner as in Example 1, except that only the pellets of the crystalline polyester mixture were used. Next, the preforms were subjected to biaxial stretch forming in the same manner as in Example 1.

However, the hardness of the preforms were high, and the preforms could not be stretched in the longitudinal direction were used which were collected from the biaxially stretch formed products that were broken as a result of the biaxial stretch forming.

Comparative Examples 5 to 8

Pellets of the amorphous polyester mixture were prepared in the same manner as in Examples 1 and 3.

Preforms were produced in the same manner as in Example 1, except that pellets of cPES1 and pellets of the respective amorphous polyester mixture were used so as to follow the compounding ratios described in Table 5. In addition, base layers were produced and surface layers were formed in the same manner as in Example 1, except that the obtained preforms were used, and thereby, electrophotographic belts according to the respective Comparative Examples were produced. The obtained electrophotographic belts were subjected to Evaluation 1 to Evaluation 5.

Comparative Example 9

A preblended sample was prepared in which cPES1, aPES1, IC and ES2 were mixed at a compounding ratio described in Table 5. The preblended sample was hot-melt kneaded with the use of the twin-screw extruder (trade name: TEX30α, manufactured by Japan Steel Works, Ltd.). The temperature in the hot melt kneading was adjusted so as to become within a range of 220° C. or higher and 300° C. or lower, and a time period of the hot melt kneading was set to 3 to 5 minutes. The obtained polyester mixture was pelletized and dried at a temperature of 140° C. for 10 hours.

A preform was produced in the same manner as in Example 1, except that only the pellet of the polyester mixture was used. Next, a base layer was produced and a surface layer was formed in the same manner as in Example 1, except that the obtained preform was used, and thereby, an electrophotographic belt according to Comparative Example 9 was produced. The obtained electrophotographic belt was subjected to Evaluation 1 to Evaluation 5.

TABLE 5

| Material abbreviation | Comparative Examples | | | | | | | | |
|---|---|---|---|---|---|---|---|---|---|
| Abbreviation | 1 | 2 | 3 | 4 | 5 | 6 | 7 | 8 | 9 |
| cPES 1 (mass %) | 98.0 | 94.0 | 0.0 | 0.0 | 75.6 | 53.0 | 75.0 | 44.0 | 70.6 |
| aPES 1 (mass %) | 0.0 | 0.0 | 98.0 | 94.0 | 20.0 | 38.0 | 16.0 | 34.0 | 20.0 |
| CB 1 (mass %) | 2.0 | 6.0 | 2.0 | 6.0 | 2.0 | 6.0 | 0.0 | 0.0 | 0.0 |
| CB 2 (mass %) | 0.0 | 0.0 | 0.0 | 0.0 | 0.0 | 0.0 | 4.0 | 10.0 | 0.0 |
| IC (mass %) | 0.0 | 0.0 | 0.0 | 0.0 | 2.4 | 3.0 | 0.0 | 0.0 | 4.4 |
| ES 2 (mass %) | 0.0 | 0.0 | 0.0 | 0.0 | 0.0 | 0.0 | 5.0 | 12.0 | 5.0 |

The evaluation results of Examples 1 to 19 and Comparative Examples 1 to 9 are shown in Tables 6 to 8. For information, in Tables 6 to 8, when the blow bottle could be formed by the biaxial stretching of the preform, "Y" was described in the column of "possibility of biaxial stretching". On the other hand, in the case where the blow bottle could not be formed due to breakage of the preform or the like in the biaxial stretching process, "N" was described in the column of "possibility of biaxial stretching".

TABLE 6

| | Examples | | | | | | | | | |
|---|---|---|---|---|---|---|---|---|---|---|
| | 1 | 2 | 3 | 4 | 5 | 6 | 7 | 8 | 9 | 10 |
| Transverse stretching magnification Lp (times) | 4 | 4 | 4 | 4 | 4 | 4 | 4 | 4 | 4 | 4 |
| Longitudinal stretching magnification La (times) | 4.3 | 4.3 | 4.3 | 4.3 | 4.3 | 4.3 | 4.3 | 4.3 | 4.3 | 4.3 |
| Possibility of biaxial stretching | Y | Y | Y | Y | Y | Y | Y | Y | Y | Y |
| Surface resistivity A (under environment of temperature of 23° C. and relative humidity of 50%) (Ω/square) | $1.1 \times 10^{10}$ | $7.4 \times 10^{9}$ | $4.6 \times 10^{9}$ | $8.0 \times 10^{9}$ | $5.8 \times 10^{9}$ | $2.6 \times 10^{9}$ | $4.5 \times 10^{9}$ | $8.4 \times 10^{8}$ | $5.2 \times 10^{8}$ | $8.1 \times 10^{9}$ |
| Surface resistivity B (under environment of temperature of 30° C. and relative humidity of 80%) (Ω/square) | $1.0 \times 10^{10}$ | $6.8 \times 10^{9}$ | $4.3 \times 10^{9}$ | $7.4 \times 10^{9}$ | $5.3 \times 10^{9}$ | $2.4 \times 10^{9}$ | $4.2 \times 10^{9}$ | $7.9 \times 10^{8}$ | $5.0 \times 10^{8}$ | $7.6 \times 10^{9}$ |

TABLE 6-continued

| | Examples | | | | | | | | | |
|---|---|---|---|---|---|---|---|---|---|---|
| | 1 | 2 | 3 | 4 | 5 | 6 | 7 | 8 | 9 | 10 |
| A/B | 1.10 | 1.09 | 1.07 | 1.08 | 1.09 | 1.08 | 1.07 | 1.06 | 1.04 | 1.07 |
| Amount of DBP absorption of carbon black (mL/100 g) | 326 | 311 | 348 | 445 | 460 | 431 | 429 | 473 | 455 | 324 |
| Elastic modulus Ep (MPa) | 1233 | 1258 | 1324 | 1253 | 1277 | 1304 | 1152 | 1184 | 1258 | 1311 |
| Elastic modulus Ea (MPa) | 1285 | 1287 | 1350 | 1269 | 1302 | 1337 | 1132 | 1156 | 1230 | 1335 |
| Shrinkage factor αp (%) | 5.35 | 5.16 | 5.09 | 5.06 | 4.96 | 4.85 | 5.36 | 5.43 | 5.59 | 3.5 |
| Shrinkage factor αa (%) | 5.41 | 5.19 | 5.14 | 5.1 | 5.02 | 4.89 | 5.28 | 5.36 | 5.51 | 3.53 |
| Number of thin line images in which scattering of toner occurred | 1 | 1 | 0 | 0 | 1 | 0 | 0 | 0 | 0 | 0 |

TABLE 7

| | Examples | | | | | | | | |
|---|---|---|---|---|---|---|---|---|---|
| | 11 | 12 | 13 | 14 | 15 | 16 | 17 | 18 | 19 |
| Transverse stretching magnification Lp (times) | 4 | 4 | 4 | 4 | 4 | 4 | 4 | 4 | 4 |
| Longitudinal stretching magnification La (times) | 4.3 | 4.3 | 4.3 | 4.3 | 4.3 | 4.3 | 4.3 | 4.3 | 4.3 |
| Possibility of biaxial stretching | Y | Y | Y | Y | Y | Y | Y | Y | Y |
| Surface resistivity A (under environment of temperature of 23° C. and relative humidity of 50%) (Ω/square) | $2.3 \times 10^9$ | $6.5 \times 10^9$ | $2.5 \times 10^9$ | $7.1 \times 10^9$ | $2.1 \times 10^9$ | $9.7 \times 10^8$ | $9.7 \times 10^9$ | $6.9 \times 10^9$ | $4.2 \times 10^9$ |
| Surface resistivity B (under environment of temperature of 30° C. and relative humidity of 80%) (Ω/square) | $2.2 \times 10^9$ | $6.2 \times 10^9$ | $2.4 \times 10^9$ | $6.6 \times 10^9$ | $2.0 \times 10^9$ | $9.1 \times 10^8$ | $8.0 \times 10^9$ | $5.8 \times 10^9$ | $3.5 \times 10^9$ |
| A/B | 1.05 | 1.05 | 1.04 | 1.08 | 1.05 | 1.07 | 1.21 | 1.19 | 1.20 |
| Amount of DBP absorption of carbon black (mL/100 g) | 452 | 448 | 319 | 337 | 459 | 316 | 324 | 341 | 312 |
| Elastic modulus Ep (MPa) | 1385 | 1260 | 1284 | 1167 | 1128 | 1117 | 1247 | 1263 | 1325 |
| Elastic modulus Ea (MPa) | 1391 | 1285 | 1306 | 1141 | 1109 | 1102 | 1256 | 1273 | 1348 |
| Shrinkage factor αp (%) | 3.34 | 4.39 | 4.25 | 4.22 | 4.18 | 4.12 | 5.21 | 5.12 | 5.03 |
| Shrinkage factor αa (%) | 3.38 | 4.41 | 4.29 | 4.15 | 4.11 | 4.09 | 5.27 | 5.06 | 5.1 |
| Number of thin line images in which scattering of toner occurred | 0 | 0 | 0 | 1 | 0 | 0 | 2 | 2 | 2 |

TABLE 8

| | Comparative Examples | | | | | | | | |
|---|---|---|---|---|---|---|---|---|---|
| | 1 | 2 | 3 | 4 | 5 | 6 | 7 | 8 | 9 |
| Transverse stretching magnification Lp (times) | — | — | — | — | 4 | 4 | 4 | 4 | 4 |
| Longitudinal stretching magnification La (times) | — | — | — | — | 4.3 | 4.3 | 4.3 | 4.3 | 4.3 |
| Possibility of biaxial stretching | N | N | N | N | Y | Y | Y | Y | Y |
| Surface resistivity A (under environment of temperature of 23° C. and relative humidity of 50%) (Ω/square) | — | — | — | — | $4.9 \times 10^9$ | $2.8 \times 10^9$ | $3.8 \times 10^9$ | $4.2 \times 10^8$ | $2.9 \times 10^9$ |
| Surface resistivity B (under environment of temperature of 30° C. and relative humidity of 80%) (Ω/square) | — | — | — | — | $1.6 \times 10^9$ | $6.9 \times 10^8$ | $1.2 \times 10^9$ | $1.0 \times 10^8$ | $5.6 \times 10^8$ |
| A/B | — | — | — | — | 3.06 | 4.06 | 3.17 | 4.20 | 5.18 |
| Amount of DBP absorption of carbon black (mL/100 g) | 322 | 319 | 345 | 340 | 309 | 323 | 418 | 433 | — |
| Elastic modulus Ep (MPa) | — | — | — | — | 1185 | 1192 | 1121 | 1036 | 1110 |
| Elastic modulus Ea (MPa) | — | — | — | — | 1154 | 1138 | 1075 | 1005 | 1102 |
| Shrinkage factor αp (%) | — | — | — | — | 5.22 | 5.19 | 5.46 | 5.69 | 5.32 |
| Shrinkage factor αa (%) | — | — | — | — | 5.09 | 5.14 | 5.63 | 5.88 | 5.43 |
| Number of thin line images in which scattering of toner occurred | — | — | — | — | 7 | 11 | 8 | 12 | 16 |

In Comparative Example 1 or 2, the amorphous polyester is not contained. Then, it is considered that when the preform has been heated at the time of the primary blow, spheroidization has been accelerated in which carbon black has acted as a crystal nucleus, the preform thereby has become hard, and accordingly, stretch blowing has been impossible.

In Comparative Example 3 or 4, the crystalline polyester is not contained. Then, it is considered that when the preform has been biaxially stretched, enhancement of the strength by oriented crystallization has not occurred, and the preform has been broken from a locally thinned portion.

In Comparative Examples 5 to 8, an ion conductive agent or a polyether ester amide is contained in a large amount. When the crystalline polyester and the amorphous polyester were used in combination, the biaxial stretching could be achieved even when carbon black was contained. However, in the obtained electrophotographic belt, the difference was greater than three times between the surface resistivity in an environment of a temperature of 23° C. and a relative humidity of 50% and the surface resistivity in an environment of a temperature of 30° C. and a relative humidity of 80%. In addition, a large number of scattered images were observed in image evaluation under an environment of a temperature of 30° C. and a relative humidity of 80%.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-181535, filed Nov. 5, 2021, and Japanese Patent Application No. 2022-097284, filed Jun. 16, 2022, which are hereby incorporated by reference herein in their entirety.

What is claimed is:

1. An electrophotographic belt comprising:

a biaxially stretched cylindrical film as a base layer containing crystalline polyester, amorphous polyester and carbon black, a content of the carbon black with respect to the biaxially stretched cylindrical film being 2.0% by mass or more, wherein a surface resistivity measured on a surface of the biaxially stretched cylindrical film in an environment of a temperature of 23° C. and a relative humidity of 50% is $1\times10^3$ Ω/square to $1\times10^{13}$ Ω/square, and A/B is 3.00 or smaller, where A (Ω/square) represents a surface resistivity measured on the surface of the biaxially stretched cylindrical film after the biaxially stretched cylindrical film is left to stand for 24 hours in an environment of a temperature of 23° C. and a relative humidity of 50%, and B (Ω/square) represents a surface resistivity measured on the surface of the biaxially stretched cylindrical film after the biaxially stretched cylindrical film is left to stand for 24 hours in an environment of a temperature of 30° C. and a relative humidity of 80%.

2. The electrophotographic belt according to claim 1, wherein A/B is 0.33 to 3.00.

3. The electrophotographic belt according to claim 1, wherein A/B is 1.00 to 3.00.

4. The electrophotographic belt according to claim 1, wherein the biaxially stretched cylindrical film contains an ion conductive agent, and a total amount of the ion conductive agent with respect to the biaxially stretched cylindrical film is 2.0% by mass or less.

5. The electrophotographic belt according to claim 1, wherein the biaxially stretched cylindrical film is free of an ion conductive agent.

6. The electrophotographic belt according to claim 1, wherein the crystalline polyester comprises at least one selected from the group consisting of polyalkylene terephthalate, polyalkylene naphthalate, polyalkylene isophthalate, and copolymers containing these components.

7. The electrophotographic belt according to claim 1, wherein the amorphous polyester comprises monomer units derived from at least one phthalic acid selected from the group consisting of terephthalic acid, orthophthalic acid and isophthalic acid, and from at least two diols selected from the group consisting of ethylene glycol, diethylene glycol, propylene glycol, neopentyl glycol and cyclohexanedimethanol.

8. The electrophotographic belt according to claim 1, wherein a content of the amorphous polyester is 100% by mass or less with respect to a content of the crystalline polyester.

9. The electrophotographic belt according to claim 1, wherein an amount of DBP absorption of the carbon black is 300 mL/100 g or more.

10. The electrophotographic belt according to claim 1, wherein a tensile elastic modulus Ep in a circumferential direction and a tensile elastic modulus Ea in a direction orthogonal to the circumferential direction of the biaxially stretched cylindrical film are both 1000 MPa or higher.

11. The electrophotographic belt according to claim 1, wherein a shrinkage factor $\alpha p$ in a circumferential direction and a shrinkage factor $\alpha a$ in a direction orthogonal to the circumferential direction of the electrophotographic belt are both 2.0% or higher.

12. An electrophotographic image forming apparatus comprising an electrophotographic belt as an intermediate transfer belt, wherein the electrophotographic belt comprises a biaxially stretched cylindrical film as a base layer, the biaxially stretched cylindrical film comprises crystalline polyester, amorphous polyester and carbon black, a content of the carbon black with respect to the biaxially stretched cylindrical film is 2.0% by mass or more, and a surface resistivity measured on a surface of the biaxially stretched cylindrical film in an environment of a temperature of 23° C. and a relative humidity of 50% is $1\times10^{3}$ Ω/square to $1\times10^{13}$ Ω/square, and A/B is 3.00 or smaller, where A (Ω/square) represents a surface resistivity measured on the surface of the biaxially stretched cylindrical film after the biaxially stretched cylindrical film is left to stand for 24 hours in an environment of a temperature of 23° C. and a relative humidity of 50%, and B (Ω/square) represents a surface resistivity measured on the surface of the biaxially stretched cylindrical film after the biaxially stretched cylindrical film is left to stand for 24 hours in an environment of a temperature of 30° C. and a relative humidity of 80%.

13. The electrophotographic image forming apparatus according to claim 12, wherein the biaxially stretched cylindrical film contains an ion conductive agent, and a total amount of the ion conductive agent with respect to the biaxially stretched cylindrical film is 2.0% by mass or less.

14. The electrophotographic image forming apparatus according to claim 12, wherein the biaxially stretched cylindrical film is free of an ion conductive agent.

15. The electrophotographic image forming apparatus according to claim 12, wherein the crystalline polyester comprises at least one selected from the group consisting of polyalkylene terephthalate, polyalkylene naphthalate, polyalkylene isophthalate, and copolymers containing these components.

16. The electrophotographic image forming apparatus according to claim 12, wherein the amorphous polyester comprises monomer units derived from at least one phthalic acid selected from the group consisting of terephthalic acid, orthophthalic acid and isophthalic acid, and from at least two diols selected from the group consisting of ethylene glycol, diethylene glycol, propylene glycol, neopentyl glycol and cyclohexanedimethanol.

17. The electrophotographic image forming apparatus according to claim 12, wherein a content of the amorphous polyester is 100% by mass or less with respect to a content of the crystalline polyester.

18. The electrophotographic image forming apparatus according to claim 12, wherein an amount of DBP absorption of the carbon black is 300 mL/100 g or more.

19. The electrophotographic image forming apparatus according to claim 12, wherein a tensile elastic modulus Ep in a circumferential direction and a tensile elastic modulus Ea in a direction orthogonal to the circumferential direction of the biaxially stretched cylindrical film are both 1000 MPa or higher.

20. The electrophotographic image forming apparatus according to claim 12, wherein a shrinkage factor $\alpha p$ in a circumferential direction and a shrinkage factor $\alpha a$ in a direction orthogonal to the circumferential direction of the electrophotographic belt are both 2.0% or higher.

* * * * *